US008631843B2

(12) United States Patent
O'Brien

(10) Patent No.: US 8,631,843 B2
(45) Date of Patent: Jan. 21, 2014

(54) DISPENSING SYSTEM

(75) Inventor: Michael O'Brien, Hertfordshire (GB)

(73) Assignee: Packaging Innovation Ltd, London (GB)

( * ) Notice: Subject to any disclaimer, the term of this patent is extended or adjusted under 35 U.S.C. 154(b) by 833 days.

(21) Appl. No.: 12/671,197

(22) PCT Filed: Jul. 22, 2008

(86) PCT No.: PCT/GB2008/050608

§ 371 (c)(1),
(2), (4) Date: Feb. 12, 2010

(87) PCT Pub. No.: WO2009/016398

PCT Pub. Date: Feb. 5, 2009

(65) Prior Publication Data

US 2010/0212778 A1 Aug. 26, 2010

(30) Foreign Application Priority Data

Jul. 30, 2007 (GB) ..... 0714769.7

(51) Int. Cl.
*B65B 1/04* (2006.01)
*B67D 7/06* (2010.01)
*A47K 5/18* (2006.01)

(52) U.S. Cl.
CPC ..... *A47K 5/18* (2013.01)
USPC ..... 141/362; 141/346; 141/360; 222/180.1; 222/181.3

(58) Field of Classification Search
USPC ..... 141/346–349, 352, 360–366; 222/180–181.3
See application file for complete search history.

(56) References Cited

U.S. PATENT DOCUMENTS

| | | | | | |
|---|---|---|---|---|---|
| 1,480,405 | A | * | 1/1924 | Long et al. | 222/181.1 |
| 1,790,228 | A | * | 1/1931 | Chambers | 222/181.2 |
| 2,583,688 | A | * | 1/1952 | Dobkin | 222/153.03 |
| 3,032,081 | A | * | 5/1962 | La Cotta | 141/362 |
| 4,505,407 | A | * | 3/1985 | Johnson | 222/181.1 |
| 4,650,095 | A | * | 3/1987 | Tella et al. | 222/153.13 |

(Continued)

FOREIGN PATENT DOCUMENTS

| | | |
|---|---|---|
| WO | WO 00/27749 | 5/2000 |
| WO | WO 2006/012600 A1 | 2/2006 |
| WO | WO 2006/134038 A1 | 12/2006 |

OTHER PUBLICATIONS

International Search Report and Written Opinion, dated Feb. 4, 2009, corresponding to PCT/GB2008/050608.

(Continued)

*Primary Examiner* — Timothy L Maust
(74) *Attorney, Agent, or Firm* — Christie, Parker & Hale, LLP

(57) ABSTRACT

A concentrate dispensing system for dispensing a fluid for dilution, comprises a bracket (1) and a bottle (2). The bracket (1) is arranged to releasably hold the bottle (2). The bottle (2) is arranged to dispense a predetermined quantity of the fluid to a first receptacle type, which is freestanding, when the bottle (2) is in a freehand mode and is not held in the bracket (1). The bottle (2) is arranged to dispense a predetermined quantity of the fluid to a second receptacle type (3), which is received and guided by the bracket (1), when the bottle (2) is in a bracket mode and is held in the bracket (1).

20 Claims, 8 Drawing Sheets

(56) References Cited

U.S. PATENT DOCUMENTS

| | | | | |
|---|---|---|---|---|
| 4,957,260 | A * | 9/1990 | Shelley | 248/311.3 |
| 5,435,465 | A * | 7/1995 | El-Amin | 222/108 |
| 5,597,019 | A * | 1/1997 | Thomas et al. | 141/18 |
| 5,896,898 | A * | 4/1999 | Crossdale et al. | 141/83 |
| 6,053,368 | A * | 4/2000 | Geimer | 222/189.09 |
| 6,179,167 | B1 * | 1/2001 | Boot et al. | 222/181.3 |
| 6,308,867 | B1 * | 10/2001 | Wolter | 222/321.6 |
| 6,568,438 | B2 * | 5/2003 | Crossdale et al. | 141/104 |
| 6,820,770 | B2 * | 11/2004 | Makino et al. | 222/180 |
| 7,104,467 | B2 * | 9/2006 | Crossdale et al. | 239/302 |
| 8,230,888 | B2 * | 7/2012 | Crossdale et al. | 141/18 |
| 8,286,835 | B2 * | 10/2012 | Morey et al. | 222/180 |
| 2004/0065673 | A1 | 4/2004 | Hansen | |
| 2006/0237482 | A1 * | 10/2006 | Vandebos | 222/181.3 |

OTHER PUBLICATIONS

British Search Report, dated Oct. 25, 2007, corresponding to priority application GB0714769.7.

International Preliminary Report on Patentability, dated Feb. 2, 2010, issued in International application No. PCT/GB2008/050608, 7 pps.

* cited by examiner

DISPENSING SYSTEM

CROSS-REFERENCE TO RELATED APPLICATION

This application is a National Phase Patent Application and claims the priority of International Application Number PCT/GB2008/050608, filed on Jul. 22, 2008, which claims priority of British Patent Application Number 0714769.7, filed on Jul. 30, 2007.

This invention relates to a dispensing system for dispensing a concentrated fluid for dilution. The concentrated fluid may be diluted with water or any other fluid, as appropriate.

Industrial cleaning products are generally supplied as concentrated fluids, for dilution with water, to provide a solution for cleaning. They are popular since they save on shipping costs, may be provided in refillable containers and may be used to produce solutions having a range of different concentrations.

In order to dispense the concentrated fluid for dilution and subsequent distribution during cleaning, a dispensing system is required. Current dispensing systems comprise fixed wall-mounted units arranged to receive handheld receptacles, such as trigger spray bottles, for dispensing a metered amount of fluid to the receptacles. Accordingly, these systems require a cleaner to return to the location of the wall-mounted unit every time they require more concentrated fluid. Additionally, when it is required to dispense fluid to larger freestanding receptacles, such as buckets or cleaning buggies, since the larger receptacles cannot be received by the wall mounted unit it is necessary to attach a hose or similar to the wall-mounted unit in order to supply the concentrate to the larger receptacles, which often results in spillages or incorrect dosing. Furthermore, the metering and dispensing means are mounted entirely within the wall-mounted unit, which increases the cost of the unit and is problematic if the unit malfunctions.

It is an object of the present invention to provide an improved dispensing system, which comprises a detachable portion, and which is effective in dispensing fluid to a range of receptacles of different dimensions.

According to a first aspect of the present invention, there is provided a concentrate dispensing system for dispensing a fluid for dilution, comprising a bracket and a bottle, wherein the bracket is arranged to releasably hold the bottle; the bottle is arranged to dispense a predetermined quantity of the fluid to a first receptacle type, which is freestanding, when the bottle is in a freehand mode and is not held in the bracket; and the bottle is arranged to dispense a predetermined quantity of the fluid to a second receptacle type, which is received and guided by the bracket, when the bottle is in a bracket mode and is held in the bracket.

In an arrangement in accordance with the present invention, since the bottle may be removed from the mount to dispense fluid in a freehand mode, the bottle may be taken to a freestanding receptacle to dispense the fluid directly therein, obviating the requirement for a hose attachment or similar and thereby preventing spillages and simplifying the construction and operation of the system.

Preferably, the predetermined volume of fluid dispensed from the bottle in the freehand mode and in the bracket mode is dependent upon whether the bottle is in the freehand mode or in the bracket mode.

By dispensing predetermined volumes of fluid in dependence on the mode of operation it is possible to provide at least two different volumes (doses) of fluid and to ensure that the correct dose of fluid is provided to each of the receptacle types, which ensures that the concentration of the solution for cleaning is correct.

Preferably, the bottle comprises a bottle actuation means, a valve and a bracket actuation means, the bottle actuation means being arranged to actuate the valve to dispense a first volume of fluid from an outlet when the bottle is in the freehand mode, and the bracket actuation means being arranged to actuate the valve to dispense a second volume of fluid from the outlet when the bottle is in the bracket mode.

By providing two actuation means that are each arranged to dispense a different volume of liquid, in dependence on the mode of operation, a user-friendly system is provided that is simple to operate, and it is further ensured that the correct volume of fluid is provided to each of the receptacle types.

Preferably, the first receptacle (associated with the freehand mode) is a bucket or a cleaning buggy and the second receptacle (associated with the bracket mode) is a handheld trigger spray bottle, with a greater volume of fluid being dispensed in the freehand mode than in the bracket mode.

The different receptacle types require different amounts of fluid to provide the same concentration of cleaning solution. The freestanding receptacles (buckets or cleaning buggies) have a greater volume than the receptacles that are received and guided by the bracket (trigger spray bottles) and therefore require a greater volume of fluid.

Preferably, the volume of fluid dispensed in the bracket mode is dependent upon the receptacle.

With the volume of fluid dispensed in the bracket mode dependent on the receptacle, it is possible to vary the volume of fluid dispensed in the bracket mode by varying the attributes of the receptacle, and to further ensure that the correct volume of fluid is dispensed.

Preferably, the bottle actuation means comprises a trigger, the trigger being arranged to engage and actuate the valve.

Preferably the system further comprises a safety lock, wherein the safety lock is arranged to bring the trigger into and out of engagement with the valve, such that in order to dispense fluid in the freehand mode the safety lock and trigger must be operated simultaneously.

By providing a safety lock that must be operated simultaneously with the trigger, it is ensured that fluid is not dispensed unintentionally when the bottle in the freehand mode. Furthermore, if the trigger and safety button are arranged such that two hands are required to dispense fluid in the freehand mode it is possible to limit the chances that a user may attempt to dispense fluid to the second receptacle type when in the freehand mode, since this would require three handed operation (a hand to support the receptacle and two hands to dispense fluid).

Preferably, the trigger and safety lock are resiliently biased to return to an operable position following their operation, with the trigger and safety lock inoperable during their return, under the biasing force, to the operable position. Most preferably, the biasing of the trigger and safety lock effects a time delay, with the return to the operable position, following operation of the trigger and safety lock, taking a predetermined time. The predetermined time may be any desired time period, preferably at least 10 seconds.

By providing a time delay function, the chances of a user providing multiple doses to a receptacle (which would result in an incorrect concentration of cleaning solution) in the freehand mode are reduced.

Preferably, the bracket actuation means comprises a dispensing head on the bottle, which is fluidly connected to the outlet, a receptacle of the second receptacle type being arranged to engage and actuate the dispensing head, and the dispensing head being arranged to engage and actuate the valve, such that engagement and actuation of the dispensing head by the receptacle, when the bottle is in the bracket mode, dispenses fluid to the receptacle.

Preferably, the bracket actuation means further comprises a resiliently biased bottle support, a resiliently biased actuation button and a receptacle support, each of which is provided on the bracket, the bottle support is arranged to support the bottle, such that it may travel vertically up and down, the actuation button is arranged to effect the downward travel of the bottle, and the receptacle support is arranged to receive and guide the receptacle, such that when the receptacle is received by the receptacle support and the actuation button is actuated, the dispensing head is brought to bear on the receptacle and the fluid is dispensed to the receptacle.

By supporting the bottle for vertical travel and providing a receptacle support that is arranged to receive and guide the bottle so that the dispensing head of the bottle is brought to bear on the receptacle, it is ensured that fluid is not dispensed unintentionally in the bracket mode, since when there is no receptacle held in the bracket the dispensing head, there will be nothing to actuate the dispensing head.

Preferably, the receptacle is provided with a collar that, in use, abuts the dispensing head and limits the vertical travel of the dispensing head, such that the volume of fluid dispensed is dependent on the height of the collar.

With the volume of fluid dispensed dependent on the dimensions of the collar it is ensured that the correct volume of fluid is dispensed to the receptacle that is received and retained by the bracket in the bracket mode.

Preferably, a range of collars of different heights are provided, such that a range of predetermined volumes of fluid may be dispensed. However, other methods of providing a receptacle with an engagement means, which can interact with bottle and bracket, will be apparent to those skilled in the art and may be used as alternatives to the collar.

With a range of collars the volume of fluid dispensed (within predetermined limits) may be made infinitely variable to suit a wide range of receptacle sizes.

Preferably, the bottle support and actuation button are resiliently biased to return to an operable position following their operation, with the bottle support and actuation button inoperable during their return, under the biasing force, to the operable position. More preferably, the biasing of the bottle support and actuation button effects a time delay, with the return to the operable position, following operation of the bottle support and actuation button, taking a predetermined time. The predetermined time may be any desired time period, preferably at least 10 seconds.

By providing a time delay function, the chances of a user providing multiple doses to a receptacle (which would result in an incorrect concentration of cleaning solution) in the bracket mode are reduced.

Preferably, the bottle is refillable and is provided with a filling cap that is provided with a microbiological filter.

By providing a microbiological filter, the bottle may be repeatedly re-filled without contamination of the fluid.

Preferably, the bracket is arranged to be mounted on a wall or on a re-locatable cleaning trolley or similar.

By arranging the bracket for mounting on a cleaning trolley the entire system may be made portable.

Embodiments of the invention will now be described, by way of example only, with reference to the accompanying drawings, in which.

Figure 2:
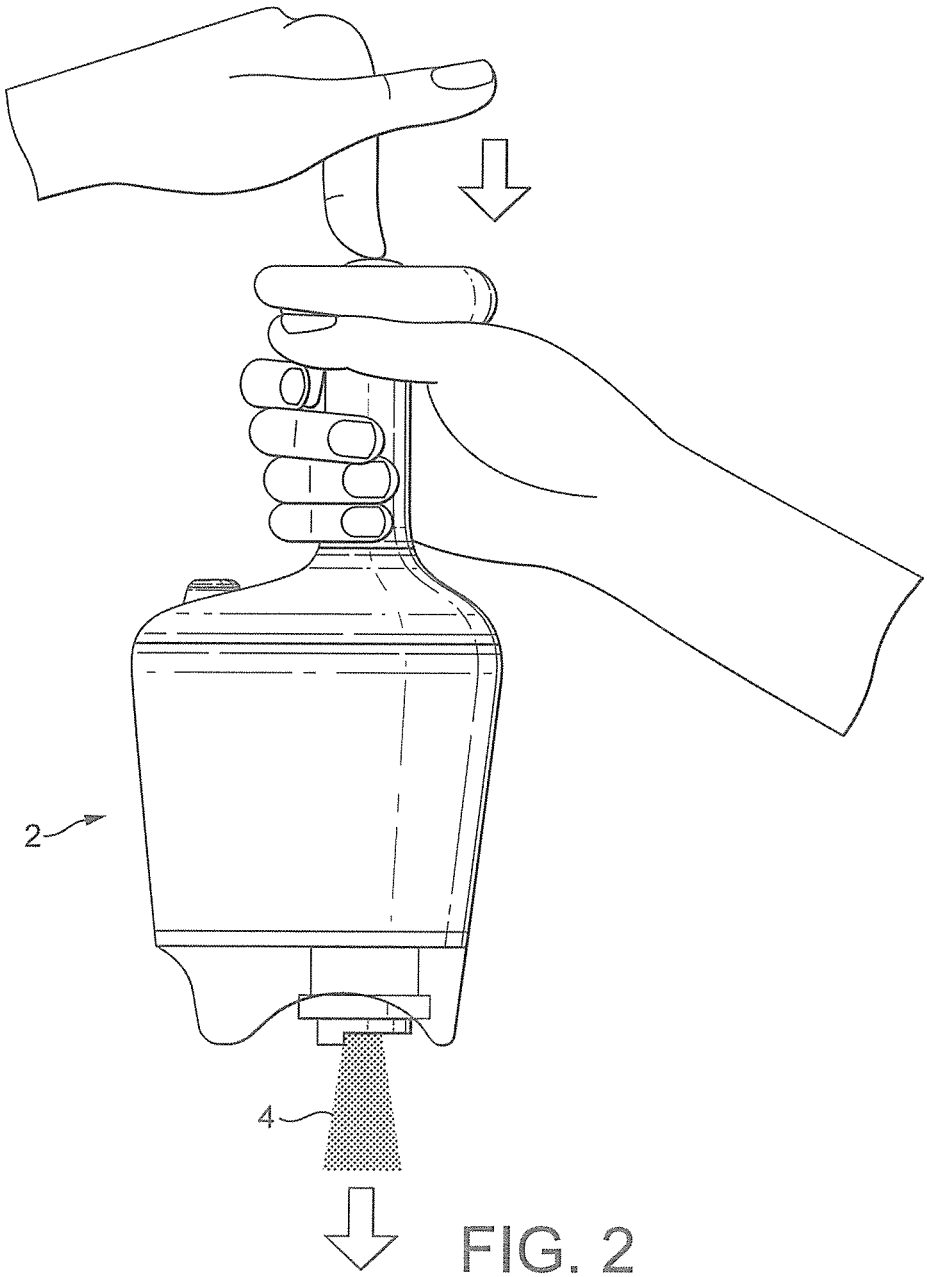
FIG. 2 illustrates the bottle of the system in the freehand mode with the trigger and the safety lock operated by a user.
Figure 3:
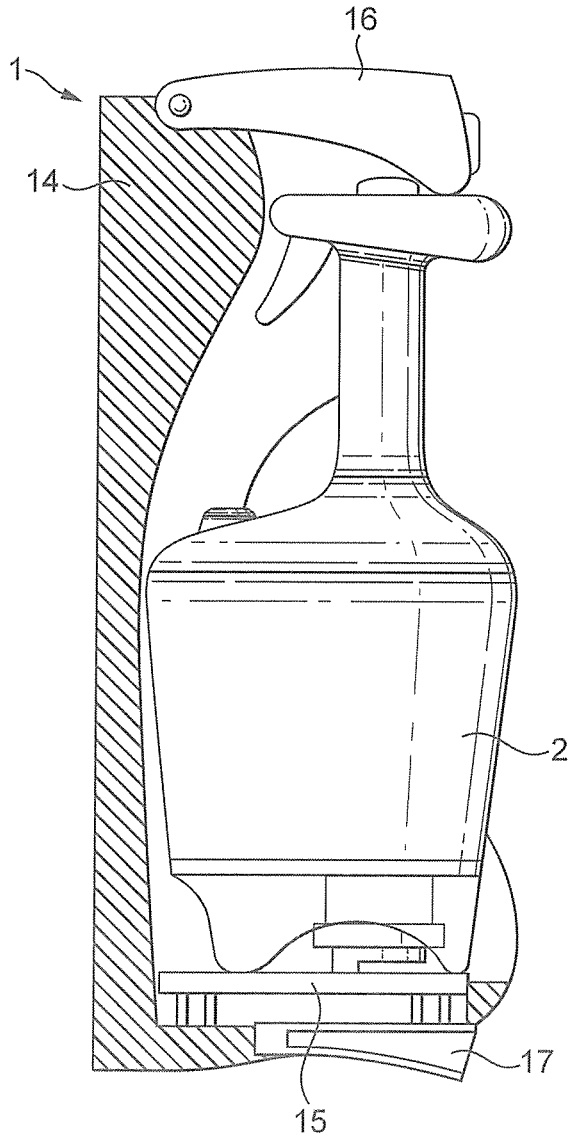
FIG. 3 illustrates a partial sectional view of the system in the bracket mode.
Figure 4:
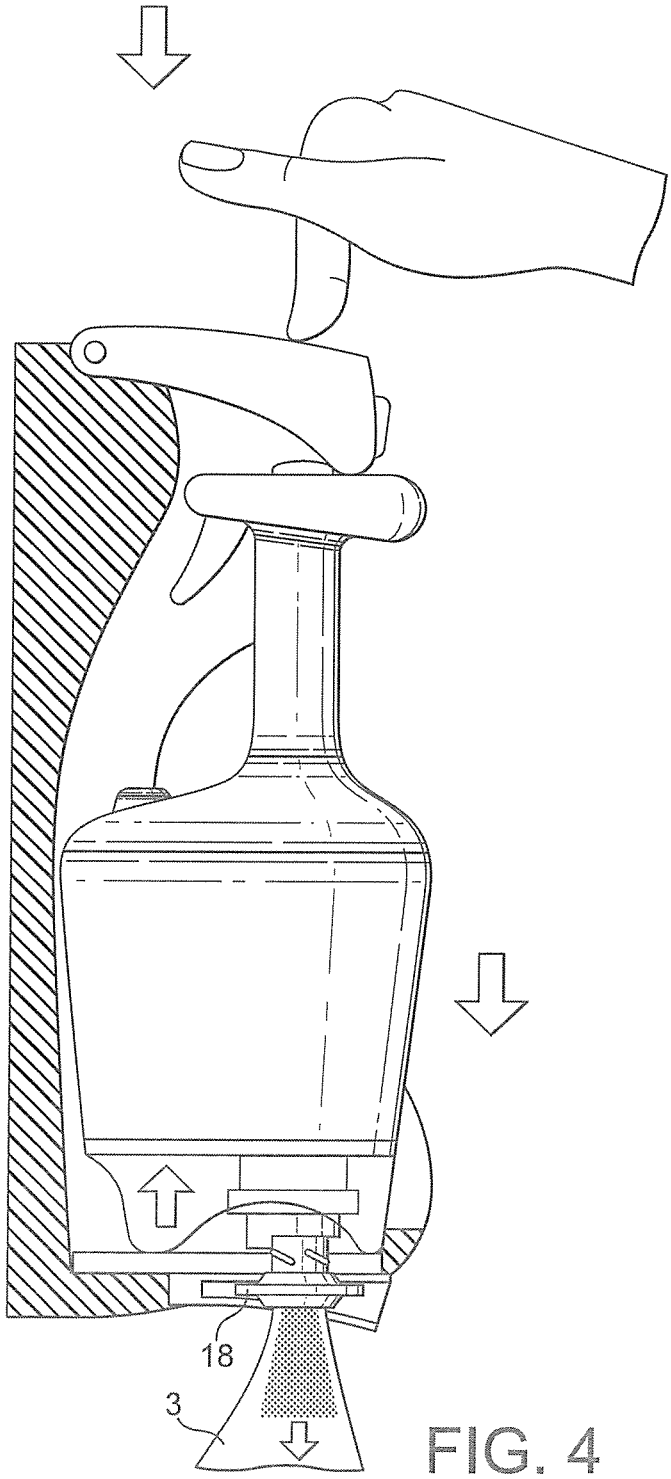
FIG. 4 illustrates a partial sectional view of the system in the bracket mode with a receptacle received by the bracket and the actuation button operated by a user.
Figure 5:
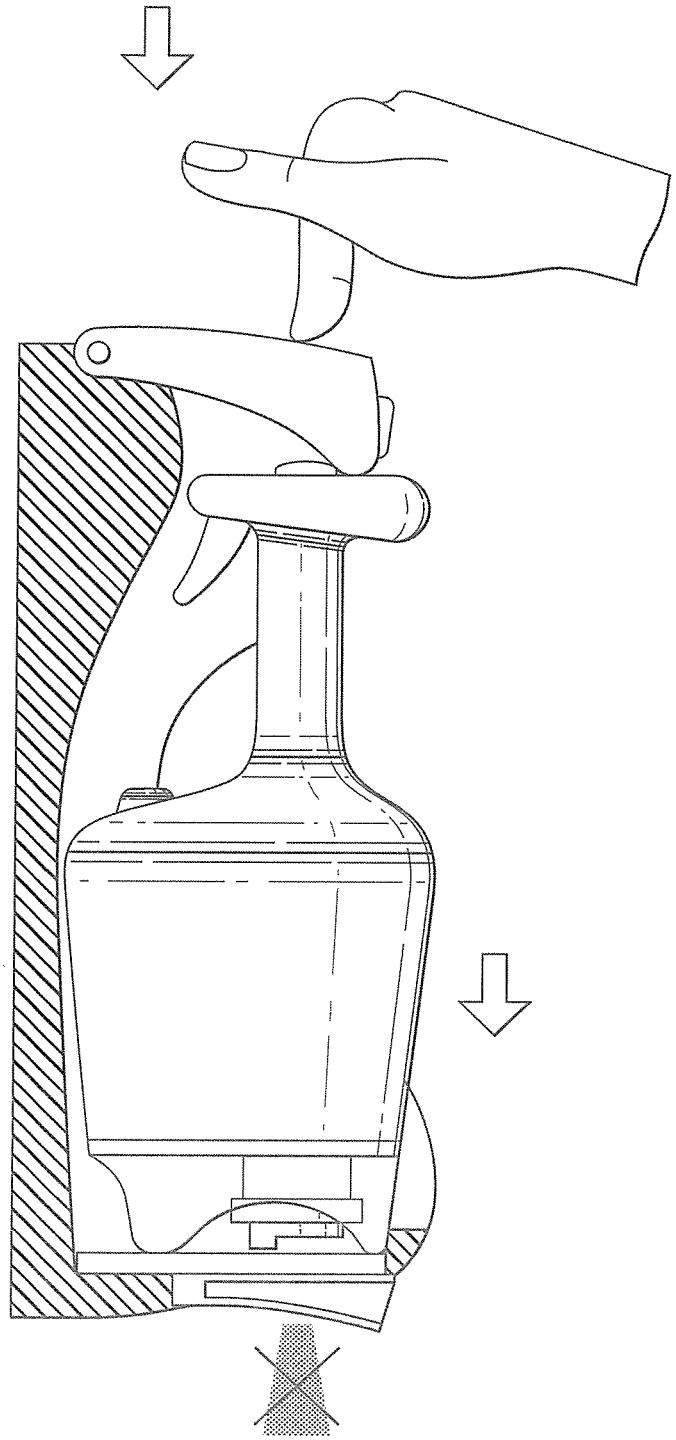
FIG. 5 illustrates a partial sectional view of the system in the bracket mode with no receptacle present and the actuation button operated by a user.

A concentrate dispensing system comprises a bracket 1 and a bottle 2, wherein the bracket 1 is arranged to releasably hold the bottle 2. The bottle 2 is arranged to dispense fluid to a first receptacle type (not shown), which is freestanding, when the bottle is in a freehand mode (as shown if FIGS. 1 and 2) and is not held in the bracket 1; and is arranged to dispense fluid to a second receptacle type (3, FIGS. 4 and 6), which is received and guided by the bracket 1, when the bottle is in a bracket mode (as shown in FIGS. 3 to 5) and is held in the bracket.

The bottle 2 is filled with a concentrated fluid 4. The bottle is provided with a bottle actuation means that allows the bottle to dispense fluid when it is in the freehand mode. The bottle actuation means comprises a trigger 5 and a safety lock 6. There is a valve (not shown) provided within the bottle 2, which is engaged and actuated by the trigger 5. Engagement and actuation of the valve by the trigger 5 is controlled by the safety lock, which is arranged to bring the trigger 5 into and out of engagement with the valve. In order to dispense a dose of fluid 4 from the bottle 2 a user must depress the safety lock 6 and pull the trigger 5 simultaneously (as shown in FIG. 2). The fluid is dispensed from an outlet (not shown) that is provided in a lower face of the bottle 2.

Actuation of the valve by the trigger 5 dispenses a predetermined volume of fluid from the outlet. The volume of fluid dispensed is pre-determined, based upon the volume of the receptacle that the fluid is to be dispensed to. If the receptacle is a bucket or a cleaning buggy, the volume will be approximately 25 ml. The predetermined volume in the freehand mode is set in dependence on the volume of the receptacle that is to be dispensed to and may be factory set or may be user adjustable by adjustment of the valve or trigger.

Figure 1:
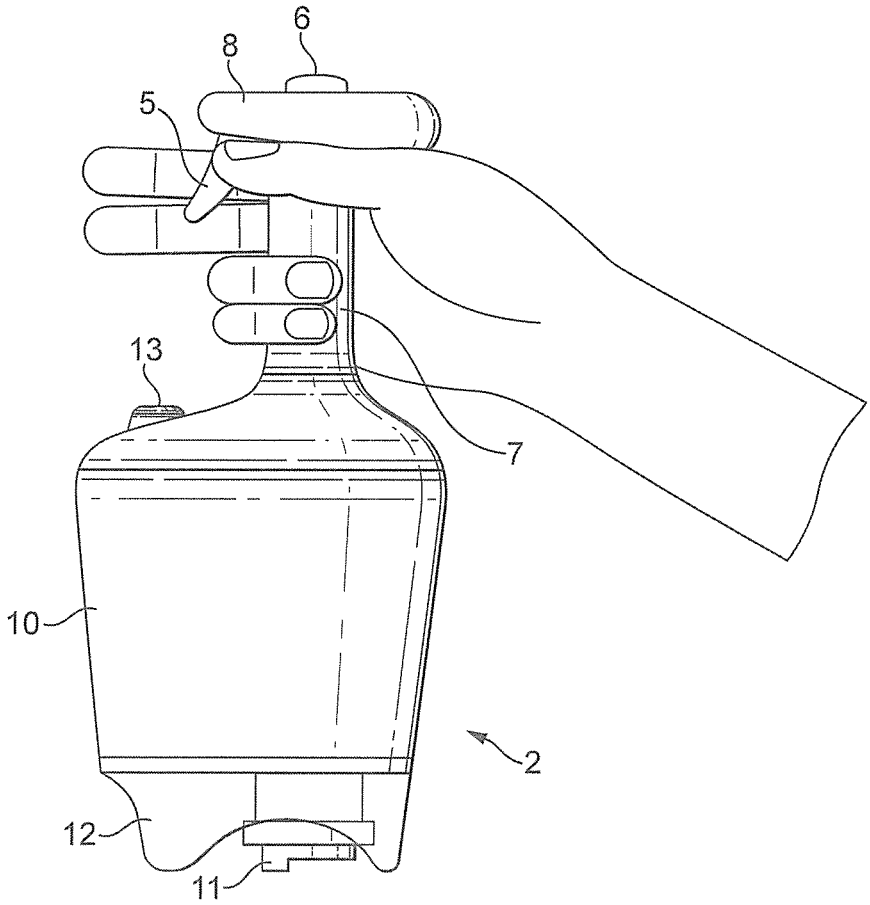
FIG. 1 illustrates the bottle of the system in the freehand mode.

The trigger 5 and safety lock 6 are biased by a biasing mechanism (not shown) to normally be in an operable position (as shown in FIG. 1). By virtue of the biasing, the trigger 5 and safety lock 6 automatically return to the operable position following the dispensing of a volume of fluid. The biasing mechanism is arranged to effect a time delay by rendering the trigger 5 and the safety lock 6 inoperable during their return to the operable position. The return to the operable position takes approximately 10 seconds but may be adapted to take more or less time.

The bottle 2 is provided with a handle, which comprises a handgrip 7 and a comfort grip 8, and a base 10. The handgrip 7 extends vertically from the base 10 and terminates in the comfort grip 8. The comfort grip 8 is arranged, in use, to sit upon a user's hand when they are gripping the handgrip 7, most preferably abutting the user's thumb and forefinger (as shown in FIGS. 1 and 2). The comfort grip 8 is of greater diameter than the handgrip 7. The trigger 5 is pivotally arranged on the handle so that in use a user may pull the trigger 5 with the fingers of a first hand, which grasps the handgrip 7. The safety lock 6 is arranged on top of the comfort grip 8 for operation with the user's other hand (as shown in FIG. 2).

Figure 7:
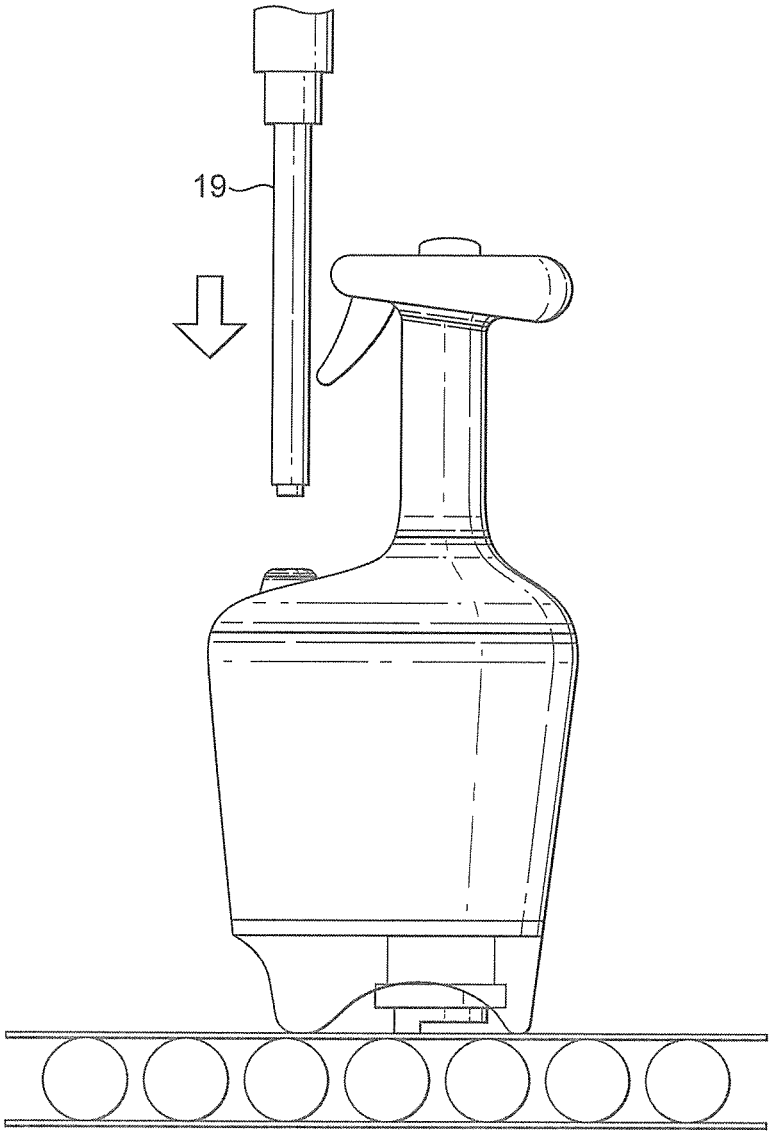
FIG. 7 illustrates the bottle of the system during a re-filling operation.

The bottle 2 is provided, on an upper surface of the base 10, with a filling cap 13 that allows the bottle 2 to be re-filled. The cap 13 is provided with a microbiological filter to eliminate the ingress of bacteria during "breathing" (replacing loss of concentrate with air) when re-filling. The cap 13 is provided in a position that is offset from the handle so that the bottle 2 may be re-filled without any disassembly of the bottle 2 required. FIG. 7 shows a re-filling operation using a nozzle 19.

The bottle 2 is provided with a dispensing head 11, which extends downwardly from the base 10 through the lower face of the bottle 2. The base 10 is provided with a downwardly extending skirt 12 that extends to a level below the dispensing head 11. The skirt 12 is provided to prevent damage and/or accidental actuation of the dispensing head 11.

The dispensing head 11 is fluidly connected to the outlet and is arranged to actuate the valve for dispensing fluid in the bracket mode. The dispensing head 11 is the main component of the bracket actuation means and is arranged to be engaged and actuated by a receptacle 3 that is received and guided by the bracket 1 in the bracket mode.

The bracket 1 comprises a body 14 that is open at its front and is arranged to receive the bottle 2. The bracket is provided with a resiliently biased bottle support 15, a resiliently biased actuation button 16 and a receptacle support 17. The bracket is arranged to securely hold the bottle 2 when it is in the bracket mode, and acts as a store for the bottle 2 when the system is not in use.

The bottle support comprises a resiliently biased platform 15, which supports the base of the bottle 1 when the bottle is held in the bracket 1. The platform 15 allows the bottle 2 to travel vertically up and down. The platform 15 is provided with an opening that is arranged to lie below the dispensing head when the bottle 2 is held in the bracket 1. The opening is provided to allow a receptacle 3, retained by the receptacle support 17 below the platform 15, to contact the dispensing head 11 during the dispensing of fluid in the bracket mode (as shown in FIG. 4). The opening is sized to be larger than a neck of the receptacle 3.

The actuation button 16 covers a portion of the comfort grip 8 of the handle when the bottle is held in the bracket 1, extending over the safety lock 6 and preventing access thereto. The actuation button 16 prevents actuation of the system in the freehand mode when the bottle 2 is held in the bracket 1. The actuation button is hinged to the body 14 of the bracket 1. The actuation button is arranged to effect the downward travel of the bottle 2 on the support 15 during dispensing of fluid in the bracket mode by application of a downward force on an upper surface of the comfort grip 8 of the handle.

The receptacle support 17 is arranged to support and guide the receptacle 3 during the bracket mode. The receptacle support 17 comprises a pair of spaced parallel channels that receive a collar 18 provided on the neck of the receptacle 3. The receptacle support 17 and collar 18 are arranged to positively locate with one another. The receptacle support 17 is arranged to bring the receptacle 3 into axial alignment with the dispensing head 11 on the bottle 2 (through the opening in the platform 15) when the bottle 2 is held in the bracket 1.

The platform 15 and actuation button 16 are resiliently biased to normally be in an operable position (as shown in FIG. 3). By virtue of the biasing, the platform 15 and actuation button 16 automatically return to the operable position following the dispensing of a volume of fluid. The biasing is arranged to effect a time delay by rendering the platform 15 and the actuation button 16 inoperable during their return to the operable position. The return to the operable position takes approximately 10 seconds but may be adapted to take more or less time.

In the bracket mode, with the receptacle 3 supported by the receptacle support 17, actuation of the actuation button 16 brings the dispensing head 11 into contact with the collar 18 provided on the receptacle 3, which results in the application of an upwards force on the dispensing head 11 (as shown in FIG. 4). The dispensing head 11 actuates the valve and dispenses a volume of liquid that is dependent on the vertical travel of the dispensing head 11. When there is no receptacle present (as shown in FIG. 5) there is no force applied to the dispensing head 11 and consequently no liquid is dispensed. Accordingly, accidental dispensing of fluid in the bracket mode is obviated.

Figure 6:
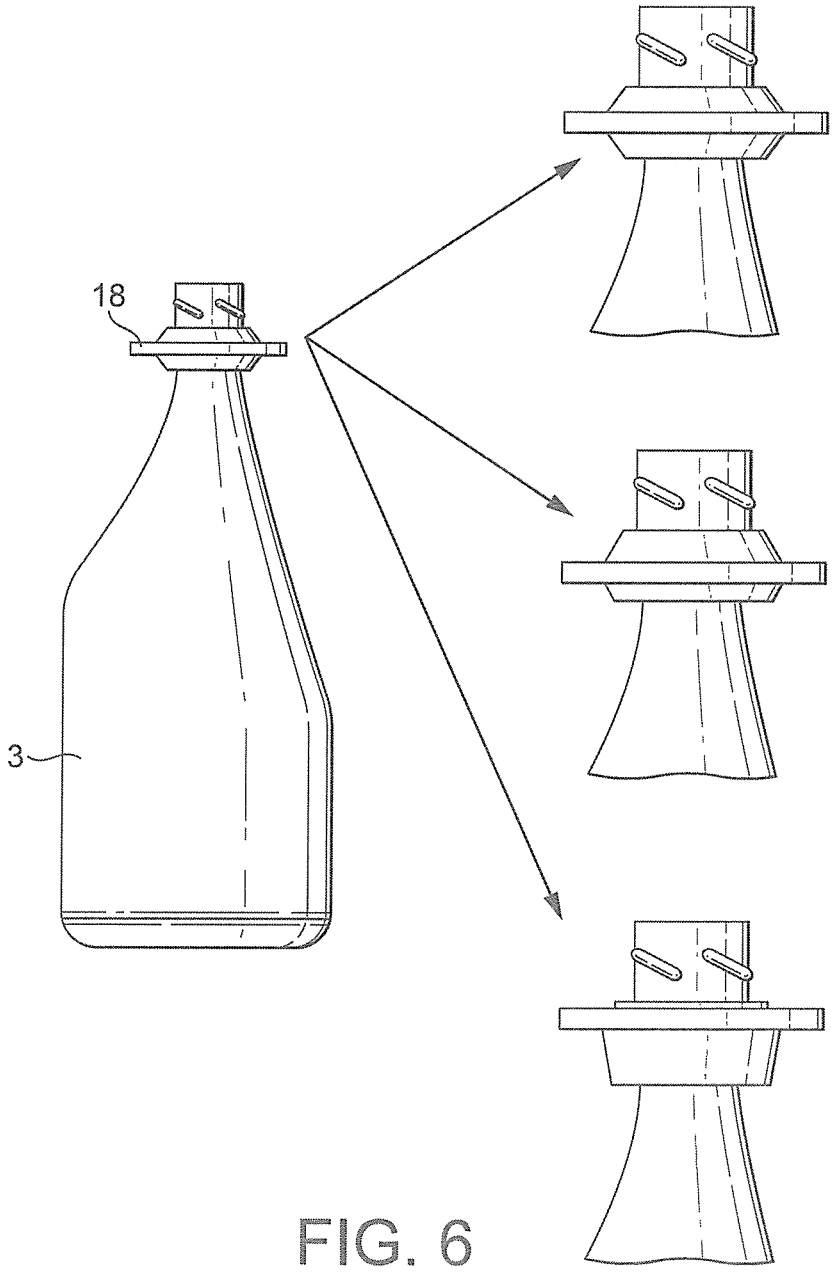
FIG. 6 illustrates a receptacle of the second receptacle type and three possible collar arrangements.

Since the volume of liquid dispensed in the bracket mode is dependent on the vertical travel of the dispensing head 11, the volume of fluid dispensed may, within upper and lower limits (e.g. 1 to 10 ml) be infinitely variable and easily matched to the appropriate receptacles 3 by simply altering the dimensions of the collars 18 on the receptacles. So long as a receptacle has the correct collar the correct volume of liquid will be dispensed to the receptacle. FIG. 6 shows a typical receptacle 3 with three alternative collar arrangements, each of which varies in its vertical dimension. The collars may be colour coded to further aid a user by, for example, providing an indication of different concentrations.

Typical receptacles used with the system in bracket mode include trigger spray bottles, which will require a volume of fluid of around 1 to 10 ml. Accordingly, the volumes of liquid dispensed in the bracket mode will be smaller than the volumes of liquid dispensed in the handheld mode.

Figure 8:
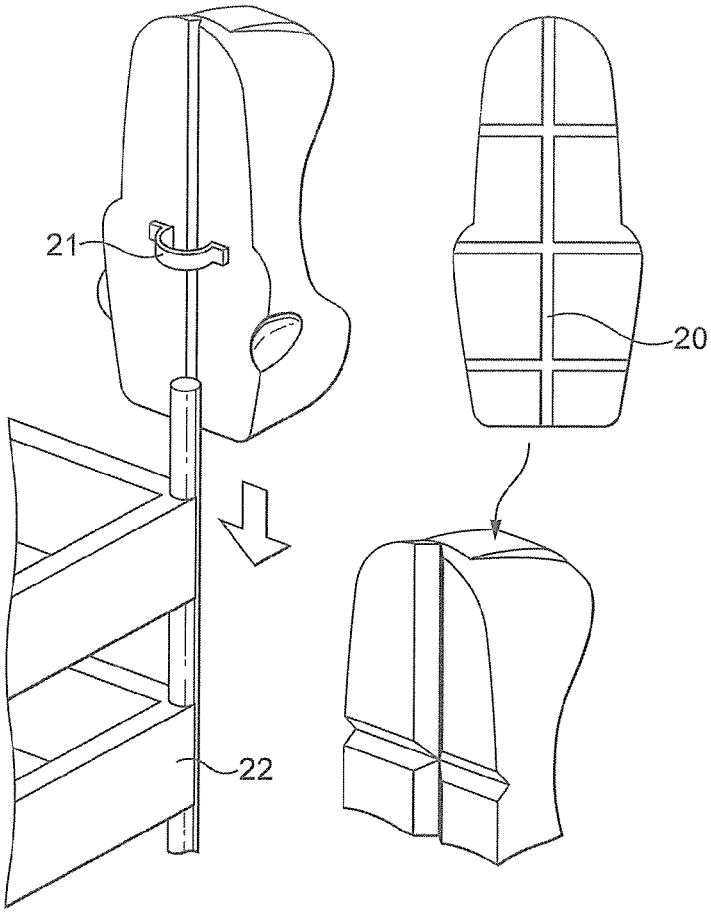
FIG. 8 illustrates a mounting arrangement of the bracket of the system on a trolley.

The bracket may be arranged to be mounted on a wall or on a re-locatable cleaning trolley or similar. FIG. 8 shows a bracket 1 that is provided with a series of grooves 20 provided in its back face and a bracket 21. The grooves 20 and bracket 21 allow for attachment of the bracket to horizontal or vertical structural members of a trolley 22.

Figure 9:
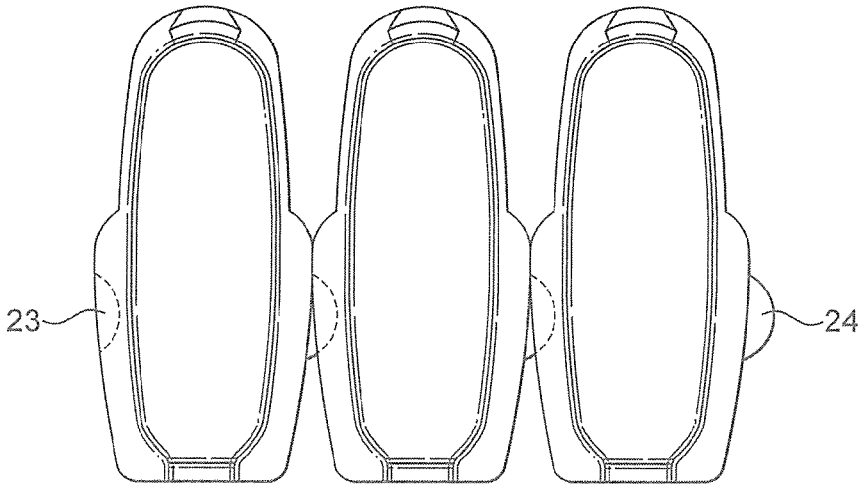
FIG. 9 illustrates three brackets mounted side by side.

There may be a bank of brackets 1 provided fixed to a wall. Such an arrangement is shown in FIG. 9. In this arrangement the brackets are each provided with a recess 23 on one side and a protrusion 24 on the other side, wherein the recesses and protrusions of adjacent brackets 1 are arranged to mate and thereby align the brackets 1.

The above description is of one specific preferred embodiment of the present invention, however, it will be appreciated that many modifications to the preferred embodiment may be possible which are within the scope of the present invention as defined by the appended claims.

The invention claimed is:

1. A concentrate dispensing system for dispensing a concentrate for dilution, comprising a bottle from which the concentrate may be dispensed, a bracket arranged to releasably hold the bottle, and a receptacle arranged to be received in the bracket when the bottle is held in the bracket, wherein the bottle comprises a bottle actuation means, a valve and a bracket actuation means, wherein the bottle actuation means is arranged to actuate the valve to permit the valve to dispense a first maximum predetermined volume of the concentrate determined by the dispensing system from an outlet when the bottle is not held in the bracket and the bottle and the bracket are arranged to prevent actuation of the bottle actuation means when the bottle is held in the bracket, and wherein the bottle, the bracket, the bracket actuation means and the receptacle are arranged to permit the valve to dispense a second maximum predetermined volume of the concentrate determined by the dispensing system, different from the first predetermined volume of the concentrate, to the receptacle when the bottle is held in the bracket and the receptacle is received in the bracket.

2. A system as claimed in claim 1, wherein the first predetermined volume of the concentrate is greater than the second predetermined volume of the concentrate.

3. A system as claimed in claim 1, wherein the second predetermined volume of the concentrate dispensed when the bottle is held in the bracket is dependent upon the receptacle type.

4. A system as claimed in claim 1, wherein the receptacle is a handheld trigger spray bottle.

5. A system as claimed in claim 1, wherein the bottle actuation means comprises a trigger, the trigger being arranged to engage and actuate the valve.

6. A system as claimed in claim 5 further comprising a safety lock, wherein the safety lock is arranged to bring the trigger into and out of engagement with the valve, such that in order to dispense the concentrate when the bottle is not held in the bracket the safety lock and trigger must be operated simultaneously.

7. A system as claimed in claim 6, wherein the trigger and safety lock are resiliently biased to return to an operable position following their operation, with the trigger and safety lock inoperable during their return, under the biasing force, to the operable position.

8. A system as claimed in claim 7, wherein the biasing of the trigger and safety lock effects a time delay, with the return to the operable position, following operation of the trigger and safety lock, taking a predetermined time.

9. A system as claimed in claim 1, wherein the bracket actuation means further comprises a dispensing head on the bottle, which is fluidly connected to the outlet, the receptacle is arranged to engage and actuate the dispensing head, and the dispensing head is arranged to engage and actuate the valve, such that engagement and actuation of the dispensing head by the receptacle, when the bottle is held in the bracket, dispenses the concentrate to the receptacle.

10. A system as claimed in claim 9, wherein the bracket actuation means further comprises a resiliently biased bottle support, a resiliently biased actuation button and a receptacle support, each of which is provided on the bracket, the bottle support is arranged to support the bottle, such that it may travel vertically up and down, the actuation button is arranged to effect the downward travel of the bottle, and the receptacle support is arranged to receive and guide the receptacle, such that when the receptacle is received by the receptacle support and the actuation button is actuated, the dispensing head is brought to bear on the receptacle and the the concentrate is dispensed to the receptacle.

11. A system as claimed in claim 9, wherein the receptacle is provided with a collar that, in use, abuts the dispensing head and limits the vertical travel of the dispensing head, such that the volume of the concentrate dispensed is dependent on the height of the collar.

12. A system as claimed in claim 11, wherein a range of collars of different heights are provided, such that a range of predetermined volumes of the concentrate may be dispensed.

13. A system as claimed in claim 10, wherein the bottle support and actuation button are resiliency biased to return to an operable position following their operation, with the bottle support and actuation button inoperable during their return, under the biasing force, to the operable position.

14. A system as claimed in claim 13, wherein the biasing of the bottle support and actuation button effects a time delay, with the return to the operable position, following operation of the bottle support and actuation button, taking a predetermined time.

15. A system as claimed in claim 1, wherein the bracket is arranged to be mounted on a wall or on a re-locatable cleaning trolley or similar.

16. A concentrate dispensing system for dispensing a fluid for dilution, the concentrate dispensing system comprising a bottle from which the fluid may be dispensed, a bracket arranged to releasably hold the bottle, and a receptacle arranged to be received in the bracket when the bottle is held in the bracket, wherein the bottle comprises a bottle actuation means, a valve, and a bracket actuation means, the bottle actuation means comprising a trigger arranged to engage and actuate the valve to dispense a first predetermined quantity of the fluid from an outlet when the bottle is not held in the bracket and the bracket actuation means being arranged to actuate the valve to dispense a second predetermined quantity of the fluid different from the first predetermined quantity of the fluid from the outlet when the bottle is held in the bracket and the receptacle is received in the bracket, the concentrate dispensing system further comprising a safety lock, wherein the safety lock is arranged to bring the trigger into and out of engagement with the valve, such that in order to dispense fluid when the bottle is not held in the bracket, the safety lock and trigger must be operated simultaneously.

17. A system as claimed in claim 16, wherein the trigger and safety lock are resiliently biased to return to an operable position following their operation, with the trigger and safety lock inoperable during their return, under the biasing force, to the operable position.

18. A concentrate dispensing system for dispensing a fluid for dilution, the concentrate dispensing system comprising a bottle from which the fluid may be dispensed, a bracket arranged to releasably hold the bottle, and a receptacle arranged to be received in the bracket when the bottle is held in the bracket, wherein the bottle comprises a bottle actuation means, a valve and a bracket actuation means to dispense a first predetermined quantity of the fluid from an outlet when the bottle is not held in the bracket and the bracket actuation means being arranged to actuate the valve to dispense a second predetermined quantity of the fluid different from the first predetermined quantity of the fluid from the outlet when the bottle is held in the bracket and the receptacle is received in the bracket, wherein the bracket actuation means comprises a dispensing head on the bottle which is fluidly connected to the outlet, the receptacle is arranged to engage and actuate the dispensing head, and the dispensing head is arranged to engage and actuate the valve such that engagement and actuation of the dispensing head by the receptacle dispenses the fluid to the receptacle when the bottle is held in the bracket.

19. A system as claimed in claim 18, wherein the bracket actuation means further comprises a resiliently biased bottle support, a resiliently biased actuation button and a receptacle support, each of which is provided on the bracket, the bottle support is arranged to support the bottle, such that it may travel vertically up and down, the actuation button is arranged to effect the downward travel of the bottle, and the receptacle support is arranged to receive and guide the receptacle, such that when the receptacle is received by the receptacle support and the actuation button is actuated, the dispensing head is brought to bear on the receptacle and the fluid is dispensed to the receptacle.

20. A system as claimed in claim 18, wherein the receptacle is provided with a collar that, in use, abuts the dispensing head and limits the vertical travel of the dispensing head, such that the quantity of the fluid dispensed is dependent on the height of the collar.

* * * * *

UNITED STATES PATENT AND TRADEMARK OFFICE

CERTIFICATE OF CORRECTION

PATENT NO. : 8,631,843 B2
APPLICATION NO. : 12/671197
DATED : January 21, 2014
INVENTOR(S) : Michael O'Brien It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 994 days.

Signed and Sealed this
Twenty-second Day of September, 2015

Michelle K. Lee

Michelle K. Lee
*Director of the United States Patent and Trademark Office*